United States Patent [19]

Toltzman

[11] Patent Number: 4,863,015

[45] Date of Patent: Sep. 5, 1989

[54] FLOWER PACKAGE APPARATUS

[76] Inventor: Randall R. Toltzman, 13372 N. 102nd Pl., Scottsdale, Ariz. 85260

[21] Appl. No.: 245,271

[22] Filed: Sep. 16, 1988

[51] Int. Cl.[4] ..... B65D 85/50

[52] U.S. Cl. ..... 206/45.14; 206/45.25; 206/423; 47/84; 229/103; 229/108

[58] Field of Search ..... 206/423, 45.25, 45.14; 229/103, 108; 47/84

[56] References Cited

U.S. PATENT DOCUMENTS 4,347,686 9/1982 Wood ..... 206/423

4,662,107 5/1987 Van Den Kieboom ..... 47/84

*Primary Examiner*—Carroll B. Dority, Jr.

*Attorney, Agent, or Firm*—H. Gordon Shields

[57] ABSTRACT

Flower package apparatus includes a blank with a plurality of fold lines, cut lines, and scored lines from which a flower package may be made. The flower package, when appropriately folded together includes three embodiments, all generally triangular in configuration. The three embodiments include a transport package, a bouquet holder, and a self standing or free standing vase. The generally triangular configuration includes three elongated sides, each of which includes elongated panels or portions and which are appropriately folded to define the different embodiments.

4 Claims, 2 Drawing Sheets

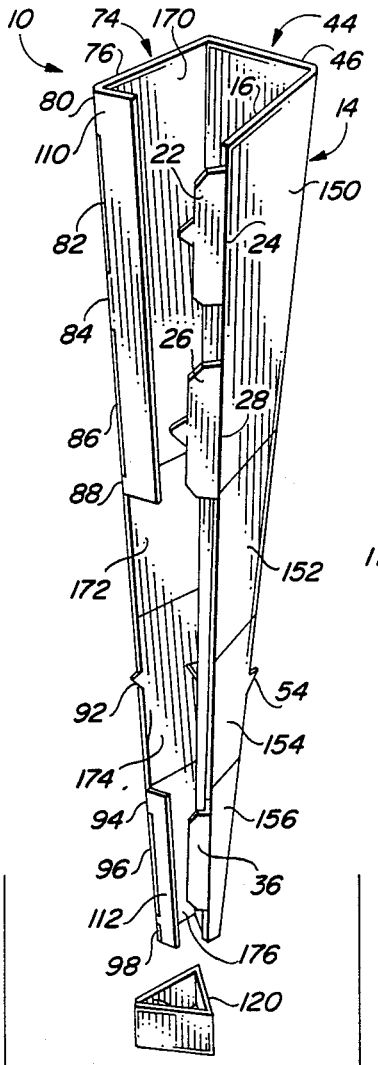
FIG. 8
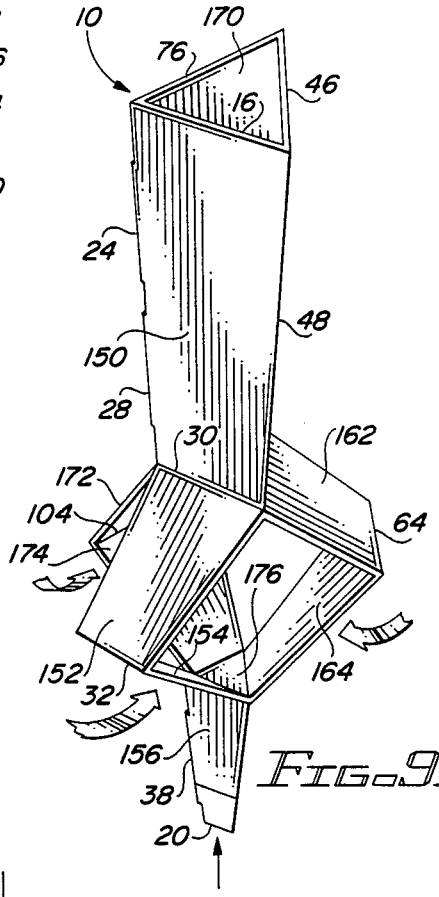
FIG. 9A
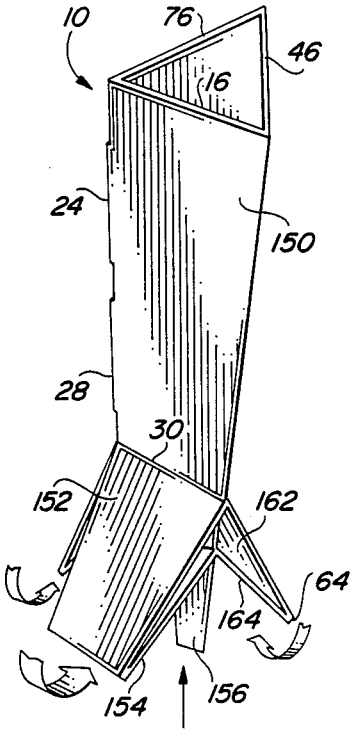
FIG. 9B
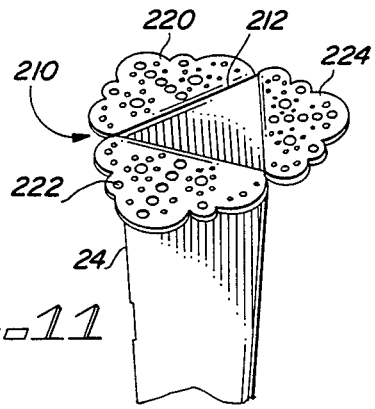
FIG. 11
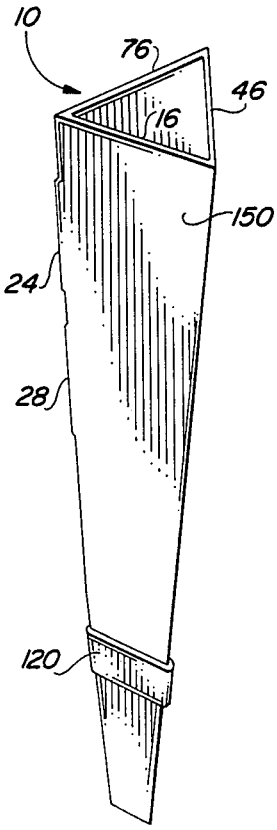
FIG. 9C
FIG. 10A
FIG. 10C
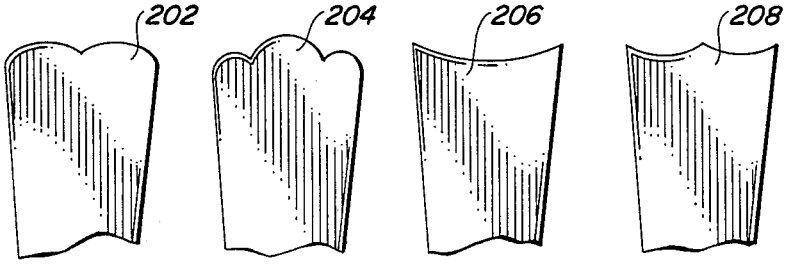
FIG. 10B
FIG. 10D

FLOWER PACKAGE APPARATUS

BACKGROUND OF THE INVENTION

1. Field of the Invention:

This invention relates to packages or containers for flowers, and, more particularly, to a package or container designed for holding a flower for transport purposes. The apparatus is capable of being transformed into a bouquet holder and/or into a vase which is self-supporting.

2. Description of the Prior Art:

The prior art includes several patents which are designed primarily for holding and transporting flowers, and thus they comprise simply containers or packages in which flowers are kept. None of the prior art patents show apparatus capable of being transformed sequentially from a transport package or container into a bouquet holder and into a vase, as part of the inherent characteristics of the basic apparatus.

U.S. Pat. No. 1,270,554 (Rubel) discloses a combination shipping box and vase which includes generally two portions, pinned together, separable for recombination as a vase. The apparatus comprises two separate portions, a top portion and a bottom portion, both of which are tapered. The two portions are secured by a pair of screws or pins. With the pins or screws removed, the top portion is removed from the bottom portion, and the bottom portion is then inserted into the top portion in an inverted manner. The top portion then becomes a bottom or stand for the apparatus, and the apparatus can then be used as a vase.

U.S. Pat. No. 1,606,523 (Gardner) discloses a package for containing and shipping potted bulbs. The potted bulb is braced within the package during transport. The package includes an elongated cylinder with a wall of the cylinder that opens and comprises an opening flap for the package. A pot disposed at the bottom of the package is braced therein by flaps which, ultimately, are held in place when the container is closed.

U.S. Pat. No. 1,811,574 (Barrett) discloses a collapsible bag which may be used to transport a package. The bag is comprised of a plurality of pleated elements which collapse or close downwardly, accordion-like, to display a potted plant disposed therein. The top of the bag includes flaps which open to allow access to the potted plant within the bag when the bag collapses downwardly or accordions downwardly.

U.S. Pat. No. 2,309,742 (Ballard et al) discloses a display and shipping container for flowers. However, the apparatus does not enclose the flowers, but merely secures them together for display and shipping purposes. The apparatus, since it does not fully enclose the flowers, does not protect them from damage while the flowers are being transported. It simply is an element used to bundle a plurality of flowers together.

U.S. Pat. No. 3,376,666 (Leonard) discloses a package for holding a plurality of flowers in a bunch. The apparatus consists of a generally truncated conically configured element which includes a plurality of holes to allow for the flow of air for flowers disposed within the apparatus. The stems of the flowers extend below the apparatus, and the buds or petal portions of the flowers are held in the largest diameter portion of the apparatus.

U.S. Pat. No. 3,767,104 (Bachman et al) discloses another type of packaging apparatus for flowers. The apparatus consists of a generally conically shaped container. At the upper portion, or widest diameter portion of the cone, is a transversely extending disc element having a plurality of holes or apertures extending through it. The stems of the flowers held by the apparatus extend through the holes in the disc.

U.S. Pat. No. 4,113,094 (Collin) discloses a shipping and display container for cut flowers. The container includes a stackable box and, without the box, a support to hold a pot for the plant, and in a second embodiment a plastic flower bucket. The plastic flower bucket is a separate element, stackable by itself, and inserted into the box or container as required.

German Pat. No. 631,054 (Hansen) discloses a box for displaying various elements. The box includes top and bottom frames and panels between the frames which are movable relative to each other to provide different embodiments. When the panels are aligned vertically with the frames, a ring is disposed about the panels to hold the panels in place.

It does not appear that the apparatus of the '742, the '666, or the '104 patents have alternate embodiments or are designed to provide a plurality of functions, as is the apparatus of the present invention, or as in the '544 (Rubel) patent.

SUMMARY OF THE INVENTION

The invention described and claimed herein comprises a package or container for flower having a plurality of panels, separable and foldable, capable of being changed from a transport mode or embodiment sequentially to either or both a bouquet holder embodiment and/or a self-supporting, free-standing vase mode or embodiment by folding the panels in different ways. The basic transport package is readily changed back and forth to and from any of its three embodiments without tools or the like.

Among the objects of the present invention are the following:

to provide new and useful package apparatus for flowers;

to provide new and useful container apparatus for flowers capable of being transformed into a bouquet holder and/or into a self-supporting vase;

to provide new and useful container apparatus having a plurality of slots at one end, and a slotted portion capable of being folded to define a plurality of feet for supporting the upper portion of the apparatus;

to provide new and useful apparatus for holding a flower for transport purposes and for display purposes;

to provide new and useful package apparatus for a flower and including a generally tapered configuration for supporting a flower and a lower, slotted portion capable of being folded to comprise a stand for supporting the upper portion of the apparatus and a flower; and to provide a new and useful blank having cut lines and fold lines for making into a flower transport package, a flower bouquet holder, and a flower stand.

BRIEF DESCRIPTION OF THE DRAWING

FIG. 8 is a perspective view illustrating the assembly of the apparatus of the present invention.

FIG. 9A is a perspective view illustrating the beginning of the transformation of the apparatus of the present invention from one embodiment to another.

FIG. 9B is a perspective view of the apparatus of the present invention showing sequentially the transformation of the apparatus following the showing of FIG. 7.

FIG. 9C is a perspective view of the apparatus of the present invention in an embodiment corresponding to FIG. 6.

FIG. 10A–10D comprise a side view of a portion of the apparatus of the present invention illustrating alternate decorative features.

FIG. 11 is a perspective view of a portion of the apparatus of the present invention illustrating another alternate decorative feature.

DESCRIPTION OF THE PREFERRED EMBODIMENT

Figures 1, 2, 3, 4, 5, 6, 7:
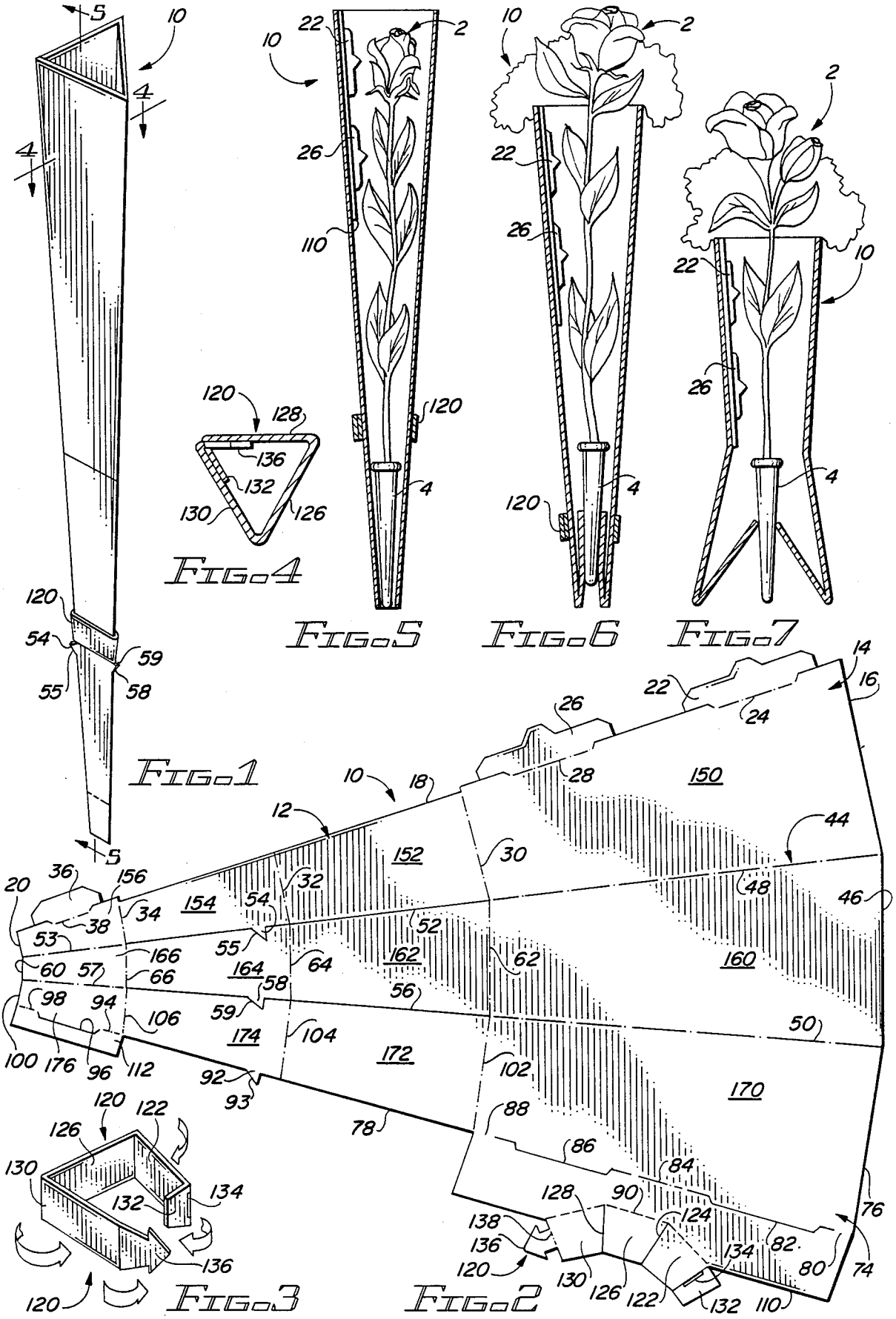
FIG. 1 is a perspective view of the apparatus of the present invention.
FIG. 2 is a plan view of the apparatus of the present invention.
FIG. 3 is a respective view of a portion of the apparatus of the present invention.
FIG. 4 is a view in partial section of the apparatus of FIG. 1, taken generally along line 4—4 of FIG. 1.
FIG. 5 is a view in partial section of the apparatus of the present invention illustrating one embodiment.
FIG. 6 is a view in partial section of the apparatus of the present invention illustrating another embodiment.
FIG. 7 is a view in partial section of the apparatus of the present invention illustrating still another embodiment.

FIG. 1 is a perspective view of flower package apparatus 10 of the present invention. The flower package apparatus 10 includes three different embodiments, each of which is illustrated respectively in FIGS. 5, 6, and 7. FIG. 5 is a view in partial section of the flower package apparatus 10 shown in partial section in its flower transport package embodiment or mode, and FIG. 6 is a view in partial section of the flower package apparatus 10 in its second, bouquet embodiment or mode. FIG. 7 is a view in partial section of the flower package apparatus 10 in its third embodiment or mode, namely a vase mode. In the vase mode, the flower package apparatus 10 is self-supporting.

FIG. 2 is a plan view of the transport package apparatus 10 as a blank 12, with appropriate fold lines and cut lines, before the blank is appropriately folded and assembled to any of its three embodiments.

FIG. 3 is a perspective view of a band 120, which is initially part of the blank 12. The band 120 is used to hold or to maintain the package apparatus in both its package or transport embodiment, as shown in FIGS. 1 and 5, and also to maintain the package apparatus 10 in its bouquet configuration or embodiment as shown in FIG. 6 and in FIG. 9C.

FIG. 4 is a view in partial section of the flower package apparatus 10 taken generally along line 4—4 of FIG. 1. FIG. 4 illustrates the triangular configuration of the package apparatus 10.

FIG. 8 is a perspective view illustrating the assembly of the package apparatus 10 from its original, blank, configuration, as shown in FIG. 2.

FIGS. 9A, 9B, and 9C are perspective views of the package apparatus 10 illustrating sequentially the conversion of the package apparatus 10 from the transport package embodiment, of FIGS. 1 and 5, to the vase embodiment of FIG. 7 and to the bouquet holder embodiment of FIG. 6.

For the following discussion, reference generally will be made to FIGS. 1–9C. Reference will be made to a specific Figure as deemed necessary for the understanding of the package apparatus 10.

Referring specifically to FIG. 3, the package apparatus 10 begins as a blank 12. The blank 12 includes three generally elongated portions, each portion of which comprises a side of the generally triangularly configured apparatus 10. The blank 12 includes a first portion 14, a second or central portion 44, and a third portion 74. Each portion includes a top edge and a bottom edge, and the first portion 14 and the third portion 74 includes outside edges. The second or center portion 44 includes side edges which it shares respectively with the first portion 14 and the second portion 74.

Each of the three portions is generally of a triangular configuration, or actually of an elongated trapezoidal configuration, using the top edges and the bottom edges, which are generally parallel to each other, as the top and bottom sides of a trapezoid. Because the top and bottom edges are so short relatively to the various side edges, the general effect of the apparatus 10, and of the individual portions 14, 44, and 74 is of a general triangularly shaped configuration. It will be noted that the side edges are of equal length and the bottom edges are of equal length, thus providing a "regular" triangular configuration.

The first portion 14 includes a top edge 16, a side edge 18, and a bottom edge 20. As indicated above, the top edge 16 and the bottom edge 20 are generally parallel to each other.

Extending outwardly from the side edge 20 are a pair of locking tabs, including an upper locking tab 22, and an upper locking tab 26, and a bottom locking tab 36.

The locking tab 22 is joined to the edge 18 by a fold line 24. The locking tab 26 is joined to the side edge 18 by a fold line 28. The locking tab 36 is joined to the side edge 18 by a fold line 38.

Between the top edge 16 and the bottom edge 20 are three additional fold lines, including a fold line 30, a fold line 32, and a fold line 34.

The second portion of the package apparatus 10, the center portion 44, includes a top edge 46, and a bottom edge 60. The edges 46 and 60 are substantially parallel to each other. The center portion 44 also includes two side fold lines or edges, including a side fold line 48 and a side fold line or edge 50. Aligned with the side fold lines or edges 48 and 50 are a pair of cut lines, including a cut line 52 and a cut line 56. The cut line 52 is longitudinally aligned with the fold line 48, and the cut line 56 is longitudinally aligned with the fold line 50.

The cut line 52 includes a spur or notch 54, and the cut line 56 includes a spur or notch 58. The spurs or notches 54 and 58 extend outwardly from the lines 52 and 56, respectively, to provide catch elements for securing the band 120 to the flower apparatus 10.

The employment of the band 120 is illustrated in FIGS. 1, 5, and 6. In FIG. 1, the spurs 54 and 58 are shown beneath the band 120. It will be noted that the spur 54 includes a sloping edge 55, and the spur 58 includes a sloping edge 57. As may be understood from FIG. 1, the sloping edges 55 and 59 act as cam edges to cause the spurs 54 and 58 to bend inwardly as the band 120 is moved upwardly from the bottom of the apparatus 10. Then, the top edges of the spurs, which are substantially perpendicular to the cut lines 52 and 56, act as a stop edge for the band 120. The spurs 54 and 58 accordingly act as stop elements to prevent the inadvertent removal of the band 120 from the package 10.

Aligned with the fold line 48 and the cut line 52 is a fold line 53. Aligned with the fold line 50 and the cut line 56 is a fold line 57. The fold lines 53 and 57 extend to the bottom edge 60.

Extending between the juncture of the fold line 58 and the cut line 62 and between the juncture of the fold line 50 and the cut line 56 is a fold line 62. The fold line 62 extends to the fold line 30 of the first portion 14. The fold line 62 is generally parallel to the top edge 56 and to the bottom edge 20.

A fold line 64 extends between the cut line 52 and the cut line 56 and comprises a continuation of the fold line 32. The fold line 64 is substantially parallel to the fold line 62, and accordingly also to the edges 46 and 60.

A fold line 66 extends between the juncture of the cut line 52 and the fold line 53 and between the juncture of the cut line 56 and the fold line 57. The fold line 66 comprises a continuation of the fold line 34, and is substantially parallel to the fold lines 62 and 64 and to the edges 46 and 60.

The third portion 70 includes a top edge 76 and a bottom edge 100. The edges 76 and 100 are generally parallel to each other. The top edge 76 comprises a continuation of the top edge 46, and the top edge 46 comprises a continuation of the top edge 16. However, as shown in FIG. 2, the edges 16, 46, and 76 are not aligned with each other. Similarly, the bottom edge 100 comprises a continuation of the bottom edge 20 and the bottom edge 60. The edges 20, 60, and 100 are similarly not aligned with each other.

The third portion 74 includes a side edge 78 which extends between the top edge 76 and the bottom edge 100.

Secured to the side edge 78 is a lock panel 110. The lock panel 110 is joined to the third portion 74 by a fold line 80, a cut line 82, a fold line 84, a cut line 86, and a fold line 88. As may be best understood from FIG. 2, the cut lines 82 and 86 receive the locking tabs 22 and 26 of the first portion 14.

Extending outwardly from the lock panel 110 is a the band 120. The band 120 is secured to the lock panel 110 by a scored line 90. The scored line 90 renders the removal of the band from the blank 12 a relatively simple procedure.

The band 120 includes three panels, which make up the three sides of the band. The three panels include an end panel 122, a central panel 126, and an end panel 130.

Between the panel 122 and the panel 126 is a fold line 124. Between the panel 126 and the panel 130 is a fold line 128.

Extending outwardly from the end panel 122, remote from the fold line 124, is a lock panel 132. The lock panel 132 is joined to the end panel 130 by a combination fold line and cut line. A cut line 134 is disposed between two folded portions joining the panels 122 and 132.

A lock tab 136 extends outwardly from the end panel 130. The lock tab 136 is joined to the panel 130 by a fold line 138. The lock tab 136 extends through the cut line 134 to secure the panels 122 and 130 together to comprise the ring 120, as illustrated in FIGS. 3 and 4.

A third spur 92 extends outwardly from the side 78. The spur 92 is substantially identical to the spurs 54 and 58. The spur 92 also includes a sloping bottom edge 93 which acts as a cam edge to cause the spur 92 to be pivoted as the band 92 is moved upwardly over the spur. Then, the spur 92, of its own inherent bias, moves outwardly again and acts as a stop to hold the band 120 in place, as shown in FIG. 1.

Adjacent to the bottom edge 100 is a lock panel 120. The lock panel 120 is secured to the edge 78 by a pair of fold lines 94 and 98. A cut line 96 extends between the fold lines 94 and 98. The fold line 98 is adjacent to the bottom edge 100. The fold line 94 is remote from the fold line 98, and accordingly is remote from the bottom edge 100.

A fold line 102 extends between the juncture of the fold line 50 and the cut line 56 to the edge 78. The fold line 102 extends to the edge 78 at the juncture of the fold line 88 at the edge 78. The fold line 102 is substantially parallel to the top edge 76 and to the bottom edge 100. The fold line 102 comprises a continuation of the fold lines 30 and 62.

A fold line 104 extends between the cut line 56 and the edge 78. The fold line 104 comprises a continuation of the fold lines 32 and 64. A fold line 106 extends between the juncture of the cut line 56 and the fold line 57 to the edge 78. The fold line 106 extends to the edge 78 at the juncture of the tab 112 and its fold line 94 at the edge 78. The fold line 106 comprises a continuation of the fold lines 34 and 66. The fold lines 102, 104, and 106 are substantially parallel to each other, and accordingly are substantially parallel to the top edge 76 and to the bottom edge 100.

The first portion 14 of the flower holder apparatus 10 is comprised of four different panels, including an upper panel 150, a middle panel 152, a lower panel 154, and a cup panel 156. The four panels 150 . . . 156 are separated from each other and are defined by the various fold lines and cut lines discussed above and as best shown in FIG. 2.

Similarly, the middle portion or center portion 44 is divided into four panels, including an upper panel 160, a middle panel 162, a lower panel 164, and a cup panel 166. The four panels are separated from each other by the various fold lines and edges, as discussed above and as shown best in FIG. 2.

Likewise, the third portion 74 is divided into four panels, including a top panel 170, a middle panel 172, a lower or bottom panel 174, and a cup panel 176. Again, the four panels are separated from each other and are defined by the various edges, cut lines, and fold lines as discussed above and as best illustrated in FIG. 2.

The four panels of each of the first, middle, or second, and third portions comprise the respective three sides for the flower package apparatus 10, as best shown in FIG. 1. The folding of the middle and lower panels, and the cup panels, as illustrated in FIGS. 9A and 9B, allow the package apparatus 10 to be converted from its transport package embodiment as shown in FIGS. 1 and 5, to the bouquet holder embodiment illustrated in FIG. 6 and 9C and/or to the vase embodiment illustrated in FIG. 7.

The folding of the blank 12, and the securing together of the locking tabs and the locking panels, is illustrated in FIG. 8. The blank 12 is appropriately folded on the fold lines 48 and 53, 50 and 57, and the locking tabs and the locking panels are appropriately folded, and the tabs are inserted in the cut lines in the panels to secure the apparatus together. The band 120 is removed along its scored line 90 prior to the folding. The locking panels 110 and 112 are folded onto the inside of the assembled apparatus, and then the tabs 22, 26, and 36 are inserted into the cut lines 82, 86, and 96, respectively. When the locking tabs are inserted, the apparatus 10 is completed from the illustration of FIG. 8 to the finished package of FIG. 1. and FIG. 5.

The band 120 is folded along the fold lines 124 and 128, and the lock panel 132 is appropriately folded to the inside of the three panels, and against the panel 130. The lock tab 136 is then inserted through the cut line or slot 134 to secure the band together. This is illustrated in FIG. 3. The assembled band is shown also in FIGS. 4 and 8. FIG. 3 illustrates, by large arrows, the folding of the panels 122, 126, and 130, and the folding and the insertion of the lock panel 132 and the lock tab 136, respectively.

In FIG. 5, a flower 2 disposed in a stem tube 4 is shown within the flower package apparatus 10. The flower package apparatus 10 in FIG. 5 is in its first embodiment, namely its transport package embodiment. The band 120 is shown disposed about the lower portion of the middle panels and on the upper portion of the lower panels and on the spurs 54 and 58. The band 120 is disposed over the fold lines 32, 64, and 104, as may be understood from FIG. 2. That is, the height of the band 120 is greater than the distance between the top of the spurs 54, 58, and 92, and the fold lines 32, 64, and 104.

The band 120 holds the transport package together in its fully elongated embodiment, in which all four of the panels of the respective first, second, and third portions are aligned with each other to comprise or to define the transport package. The stem 24 is disposed within the three cup panels.

In FIG. 6, the lower panels are inverted to move the cup panels and the stem tube upwardly and accordingly to move the blossom of the flower 2 out of the top of the package. In this configuration, the package apparatus 10 is in its bouquet embodiment, shown in FIGS. 6 and 9C.

In FIG. 7, and in FIGS. 9A and 9B, the lower and middle panels are appropriately folded, with the middle panels extending outwardly and with the lower panels extended or folded inwardly, to comprise a self-supporting vase embodiment. The cup panels extend downwardly beneath the lower panels, and the juncture of the lower panels and the bottom panels comprise the three legs which comprise the supports for the vase embodiment. With three supporting legs, the vase embodiment is very stable.

FIGS. 9A and 9B illustrate sequentially the folding of the cup panels, the lower panels, and the middle panels.

FIG. 10 comprises a composite illustration of top portions and/or edges 202, 204, 206, and 208 which may be utilized for decorative purposes.

A fancy "lace" top is illustrated in FIG. 11. FIG. 11 is a perspective view of the upper portion of apparatus 210, showing outwardly extending decorative lace panels. The decorative lace panels include a panel 220, a panel 222, and a panel 224. The decorative panels 220, 222, and 224 extend outwardly from a continuous top edge fold line 212 of the package apparatus 210. As may be understood, the top edge 212 actually comprises the top edges of the three top panels of the apparatus, and the three decorative panels 220, 222, and 224 are connected to the three top panels by the fold lines.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Flower holder apparatus formed by a relatively flat blank comprising;

a top edge, including
- a first portion,
- a second portion connected to the first portion, and
- a third portion connected to the second portion remote from the first portion;

a bottom edge remote from the top edge, including
- a first portion generally parallel to the first portion of the top edge,
- a second portion connected to the first portion and generally parallel to the second portion of the top edge, and
- a third portion connected to the second portion remote from the first portion and generally parallel to the third portion of the top edge;

a first side extending from the first portion of the bottom edge remote from the second portion of the bottom edge to the first portion of the top edge remote from the second portion of the top edge;

a second side extending from the third portion of the bottom edge remote from the second portion of the bottom edge to the third portion of the top edge remote from the second portion;

first line means extending from the bottom edge between the first and second portions to the top edge between the first and second portions;

second line means extending from the bottom edge between the second and third portions to the top edge between the second and third portions, the first and second line means dividing the blank into a first blank portion, a second blank portion, and a third blank portion, and the first side, the first line means, the second line means, and the second side extending generally straight and generally diverging away from each other from the bottom edge to the top edge;

a first fold line on the first blank portion generally parallel to the first portions of the top and bottom edges extending from the first side to the first line means;

a second fold line on the first blank portion generally parallel to the first fold line extending from the first side to the first line means;

a third fold line on the first blank portion generally parallel to the first and second fold lines extending from the first side to the first line means;

a first fold line on the second blank partion generally parallel to the second portions of the top and bottom edges of the second blank portion extending from the first fold line of the first blank portion at the first line means to the second line means;

a second fold line on the second blank portion generally parallel to the first fold line on the second blank portion extending from the second fold line of the first blank portion at the first line means to the second line means;

a third fold line on the second blank portion generally parallel to the second fold line on the second blank portion extending from the third fold line of the first blank portion at the first line means to the second line means;

a first fold line on the third blank portion generally parallel to the third portions of the top and bottom edges of the third blank portion extending from the first fold line of the second blank portion at the second line means to the second side;

a second fold line on the third blank portion generally parallel to the first fold line on the third blank portion extending from the second fold line of the second blank portion at the second line means to the second side;

a third fold line on the third blank portion generally parallel to the second fold line on the third blank portion extending from the third fold line of the second blank portion at the second line means to the second side the first, second, and third fold lines of the respective first, second, and third panel portions defining respectively top, middle, lower, and cup portions of the first, second, and third blank portions from the top edge to the bottom edge;

first cut line means in the first line means extending from the first fold lines of the first and second blank portions to the third fold lines of the fist and second fold lines;

first notch means on the first cut line between the second and third fold lines of the first and second blank portions;

an upper fold line on the first line means extending from the first and second portions of the top edge to the first fold lines on the first and second blank portions;

a lower fold line on the first line means extending from the third fold line of the first and second blank portions to the first and second portions of the bottom edge;

second cut line means on the second line means extending from the first fold lines of the second and third blank portions to the third fold lines of the second and third blank portions;

an upper fold line on the second line means extending from the first and second portions of the top edge to the fist fold lines of the second and third blank portions;

a lower fold line on the second line means extending from the third fold lines of the second and third blank portions to the second and third portions of the bottom edge;

means for securing together at least a portion of the first and second blank portions at the first and second edges to define a generally triangularly shaped flower holder extending outwardly and upwardly from the bottom edge to the top edge, and having a cup portion for receiving a flower stem including the cup portions of the first, second, and third blank portions, an upper display portion including the top portions of the first, second, and third panel portions, and a stand portion including the middle and lower portions of the first, second, and third panel portions, said blank adapted to form, (1) a transport package when the panel portions of the first, second, and third blank portions are respectively aligned, (2) a bouquet holder when the top, middle and lower portions of the first, second, and third panel portions are respectively aligned and the cup portion is disposed within the lower panel portions, and (3) a display stand when the cup portion is within the lower panel portions of the first, second, and third blank portions, and the lower panel portions of the first, second, and third blank portions are within the middle panel portions of the first, second, and third blank portions; and an elongated ring portion extending outwardly from the second side, and the elongated ring portion is adapted to the removed from the blank to form a ring means about the lower portions of the first, second and third blank portions when the first and third blank portions are secured together.

2. The apparatus of claim 1 in which the second line means further includes second tab means aligned with the first tab means of the first line means for locking the ring means onto the lower panel means.

3. The apparatus of claim 1 in which the second edge includes third tab means aligned with the first and second tab means for locking the ring means on the lower panel means.

4. The apparatus of claim 1 in which the ring portion includes a first end portion and a second end portion, and the first and portion is adapted to be secured to the second end portion to comprise the ring means.

* * * * *